United States Patent [19]

Parker

[11] Patent Number: 4,680,682

[45] Date of Patent: Jul. 14, 1987

[54] WATERPROOF FLASHLIGHT

[76] Inventor: David H. Parker, 2255 Jefferson St., Torrance, Calif. 90501

[21] Appl. No.: 904,699

[22] Filed: Sep. 8, 1986

[51] Int. Cl.[4] ..... F21L 7/00

[52] U.S. Cl. ..... 362/158; 362/204; 362/205

[58] Field of Search ..... 362/158, 202, 203, 204, 362/205, 187, 109, 118, 398

[56] References Cited

U.S. PATENT DOCUMENTS

| | | | |
|---|---|---|---|
| 3,162,376 | 12/1964 | Furuya | 362/158 |
| 3,792,389 | 2/1974 | Murphy | 362/205 |
| 4,472,766 | 9/1984 | Hung | 362/158 |

*Primary Examiner*—Douglas Hart

*Attorney, Agent, or Firm*—Matthew P. Lynch

[57] ABSTRACT

A waterproof flashlight in which there is utilized a lens housing movably mounted on a tubular barrel. Within the tubular barrel is located one or more batteries and also a light bulb with the light bulb to emit light through the lens housing. An elastomeric seal is to be located between the lens housing and the tubular barrel to prevent entry of water within the tubular barrel. A switch assembly is to be mounted on the tubular barrel which when moved will activate and deactivate the light bulb. The switch assembly includes a magnetically sensitive reed switch assembly mounted within the tubular barrel. This reed switch assembly is to be activated by a movable magnet mounted on the exterior surface of the tubular barrel.

3 Claims, 12 Drawing Figures

WATERPROOF FLASHLIGHT

BACKGROUND OF THE INVENTION

The field of this invention relates to the construction of a hand held lighting device which is constructed to prevent entry of water within the flashlight even if the flashlight is used in an underwater enviroment.

The use of flashlights has long been known. Over the years flashlights have been constructed in numerous ways. Most often a flashlight has been constructed in a manner to make the flashlight as inexpensive as possible.

One of the enemies to any flashlight is moisture. Flashlights may frequently set around for a substantial period of time prior to usage. When an individual grasps a flashlight and attempts to use such, it is very common that the moisture has penetrated the flashlight and has caused corrosion of the electrical switch assembly incorporated therein as well as the battery terminals. It is rather common that the corrosion is sufficient to require discarding of the flashlight.

Even though moisture is most undesirable in conjunction with flashlights, there is a need for usage of a flashlight within an underwater environment. Not only can flashlights be utilized underwater within lakes, ponds and oceans, possibly the usage of a flashlight may be required within septic tanks, cisterns and fresh water tanks located in and around a house or a farm.

There have been attempts in the past to construct a waterproof flashlight. However, most of these attempts have failed miserably with the moisture able to quickly penetrate to within the interior of the flashlight and result in premature corrosion of the parts of the flashlight making the flashlight inoperable.

There has long been a need for a flashlight which is constructed in a simple manner and which is submersible to a substantial depth within water during usage.

SUMMARY OF THE INVENTION

A waterproof flashlight which utilizes an elongated tubular barrel which has a hollow chamber within which is to be located a plurality of batteries. The positive contact of the batteries is to physically connect with the light bulb. The light bulb is to be enclosed within a lens housing which is screw threadingly connected to the tubular barrel. In one embodiment of this invention, activation of the light bulb of the flashlight is caused by movement of the lens housing relative to the tubular barrel. In the other embodiment of this invention, the lens housing is moved to a tightened position relative to the tubular barrel. Within this embodiment, the lens housing includes an outer opaque cover and an inner transparent cover with a reflector being fixedly mounted in conjunction with the transparent cover. The light bulb is positioned centrally within the reflector and when the light bulb is activated, the light emitted therefrom is transmitted through the transparent cover into the ambient. Within this embodiment there is incorporated a magnetic switch assembly with a magnet being mounted exteriorly of the tubular barrel. Mounted within the tubular barrel in close proximity to the magnet is a reed switch assembly. The magnetic force from the magnet is to cause activation of the reed switch assembly to result in turning "on" and "off" of the light bulb.

DETAILED DESCRIPTION OF THE SHOWN EMBODIMENTS

Figure 1:
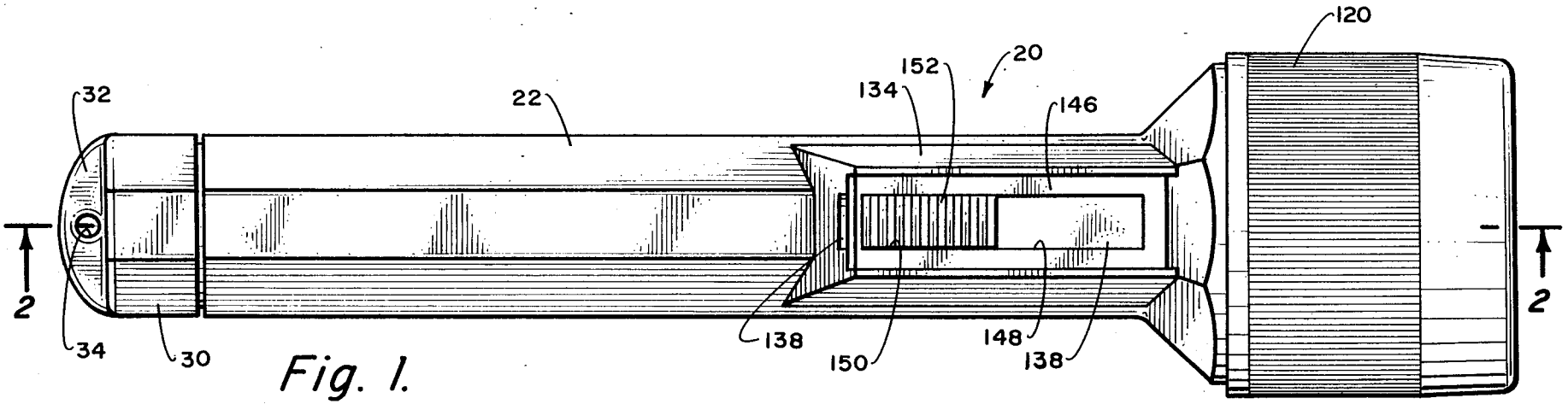
FIG. 1 is a side elevational view of one embodiment of the waterproof flashlight of the present invention.
Figure 2:
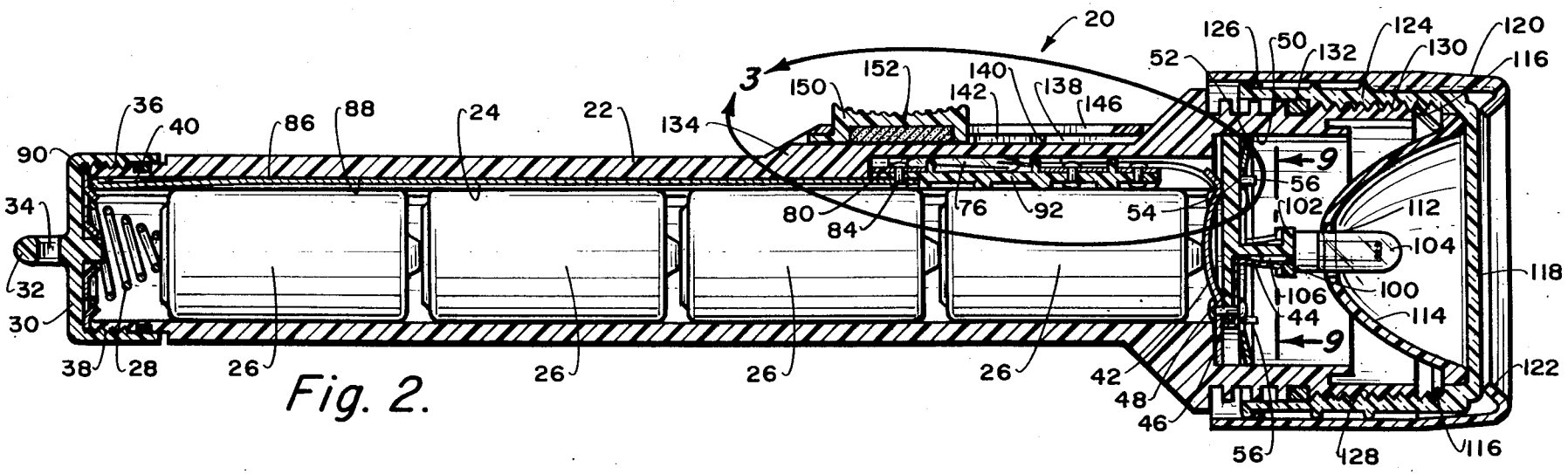
FIG. 2 is a cross-sectional view of the waterproof flashlight of FIG. 1 taken along line 2—2 of FIG. 1.

Referring particularly to the drawings there is shown in FIGS. 1 through 9 the first embodiment 20 of the flashlight of this invention which is composed of a tubular barrel 22 which has a hollow open-ended internal chamber 24. Within the internal chamber 24 there is to be located a plurality of batteries 26 located in an in-line, abutting relationship. The negative terminal of the rearwardmost battery 26 abuts against a spring 28. The spring 28 is fixedly mounted within an end cap 30. Exteriorly formed on the end cap 30 is a flange 32 within which is located a hole 34. The function of the hole 34 is to facilitate hanging of the flashlight 20 of this invention on a nail or other similar type of hanging instrument when not in use.

The end cap 30 defines a recess which includes a series of internal threads 36. The threads 36 are engaged with threaded section 38 formed on the exterior surface of the tubular barrel 22. Also mounted on the tubular barrel 22, adjacent the threaded section 38, is an elastomeric O-ring seal 40. When the cap 30 is threadably secured with the threaded section 38, the O-ring seal 40 forms a watertight seal preventing entry of water between the cap 30 and the barrel 22 to within the internal chamber 24.

The positive terminal of the forwardmost battery 26 is in continuous electrical connection with electrical contact 42. This electrical contact 42 is electrically connected by a rivet 46 to an electrical contact strip 44. The rivet 46 is fixedly mounted through a plastic disc 48. The disc 48 is fixedly mounted within enlarged chamber 50 of the tubular barrel 22. The chamber 50 directly connects with the internal chamber 24. The disc 48 is fixedly held in position against the narrowed down wall section between chambers 24 and 50 by means of metallic ring 52. The ring 52 has a central enlarged opening 54 which tightly abuts against upstanding pins 56 thereby not only securing ring 52 in position, but also fixing in position the disc 48 within the chamber 50.

Also mounted by rivets 58 and 60 within the disc 48 are electrical contact strips 62 and 64 respectively. Rivet 58 is connected by wire 66 to fixed contact 68 of a reed switch bubble 70. Rivet 60 is connected by electrical wire 72 to fixed contact 74 of a reed switch bubble 76. Cantileverally supported within the reed switch 70 is a movable contact 78. The movable contact 78 extends exteriorly of the reed switch bubble 70 and is fixed to plate 80 and is in electrical connection therewith. In a similar manner, the reed switch bubble 76 includes a movable contact 82 which extends exteriorly of the reed switch bubble 76 and is also fixedly electrically connected to plate 80. The plate 80 is then fixedly mounted onto a portion of the tubular barrel 22 by means of a rivet 84. The rivet 84 also provides electrical connection to a strip 86. This strip 86 is mounted within a groove 88 formed within the tubular barrel 22. A strip 88 is to be in electrical contact with a disc 90 which is mounted within the recess of the end cap 30. The spring 28 is fixedly mounted onto the disc 90. Therefore, an electrical ground is conducted from the batteries 26 through the spring 28 to the disc 90 through the strip 86 to movable contacts 78 and 82 of the switch assembly.

It is to be noted that the reed switch bubbles 70 and 76 will normally be manufactured of glass or plastic so that the movable contacts 78 and 82 are not subject to be knocked out of position during normal use of the flashlight, but will remain in their established position which at rest is that the movable contact 82 will be spaced a slight distance from the fixed contact 74 and the movable contact 78 will be spaced a slight distance from the fixed contact 68. For purposes of illustration, it is to be noticed in FIG. 7 that the contacts 68, 74, 78 and 82 are shown in a side-by-side relationship as such are in FIGS. 3 and 4. However, it is to be understood that in FIG. 7 they would be located one above the other and one would not be able to see the relationship between the contacts in FIG. 7. Therefore, for illustrative purposes, these contacts are again shown side-by-side in FIG. 7. The reed switch bubbles 70 and 76 are mounted onto a plate 92. This plate 92 is mounted within an appropriate slot 94 formed within the wall of internal chamber 24.

Integrally connected to disc 48 is an upstanding protrusion 102. Contact 64 connects with hole 96 formed within upstanding protrusion 102. Contact 62 connects with hole 98 formed within the protrusion 102. In a similar manner the contact 44 connects with hole 100 formed within protrusion 102. The protrusion 102 functions as a mount for light bulb 104. The light bulb 104 has terminal prongs 106, 108 and 110. Prong 106 is in electrical connection with the strip 44. Prong 108 is in electrical connection with the strip 62. Prong 110 is in electrical connection with the strip 64.

The light bulb 104 extends through hole 112 of a reflector 114. The reflector 114 is fixedly held in position by spring members 116 to the interior wall of a transparent inner cover 118. The transparent inner cover 118 is encased within an opaque outer cover 120. The front wall of the inner cover 118 is engaged with bent over flange 122 of the outer cover 120 and retained in connection therewith. Bent over flange 122 forms an enlarged opening through which the light emitted from the light bulb 104 is emitted into the ambient through transparent inner cover 118.

Transparent inner cover 118 includes a sleeve section 124. The sleeve section 124 is press-fitted within the outer cover 120 with there being an elastomeric seal 126 located therebetween in order to prevent entry of moisture between the sleeve section 124 and the outer cover 120. The interior wall surface of the sleeve 124 includes screw threads 128. Screw threads 128 are to threadably engage with threaded section 130 of the tubular barrel 22. Located between the interior of the sleeve section 124 and the tubular barrel 22 is an elastomeric O-ring seal to also prevent the entry of water into enlarged chamber 50. In actual practice it has been found that the flashlight 20 of this invention will be capable of being submerged up to two thousand feet within water without leaking.

The tubular barrel 22 includes an integral raised section 134. The apex portion of the raised section 134 includes a longitudinal recess 136. Formed within the recess 136 and centrally disposed in relation thereto is a longitudinal slot 138. Formed within one of the side walls of the slot 138 is a cutout section 140. Mounted within the cutout section 140 is a spring 142. The spring 142 includes a protuberance 144. The protuberance 144 projects into the area defined by the slot 138.

Figure 3:
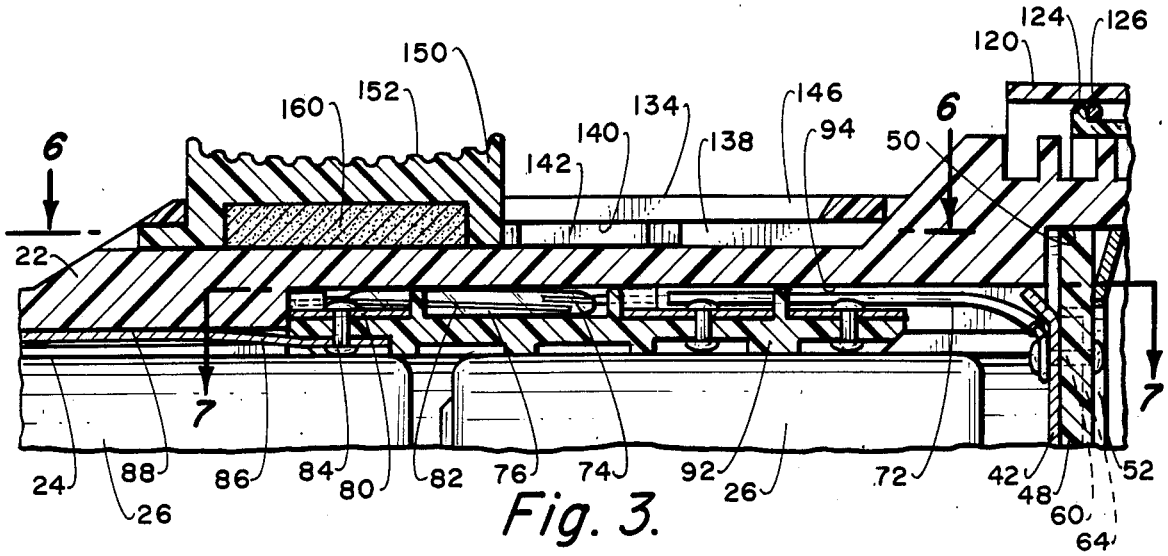
FIG. 3 is an enlarged cross-sectional view of the switch assembly incorporated within the waterproof flashlight of this invention taken along line 3—3 of FIG. 2, showing the switch in the "off" position.
Figure 4:
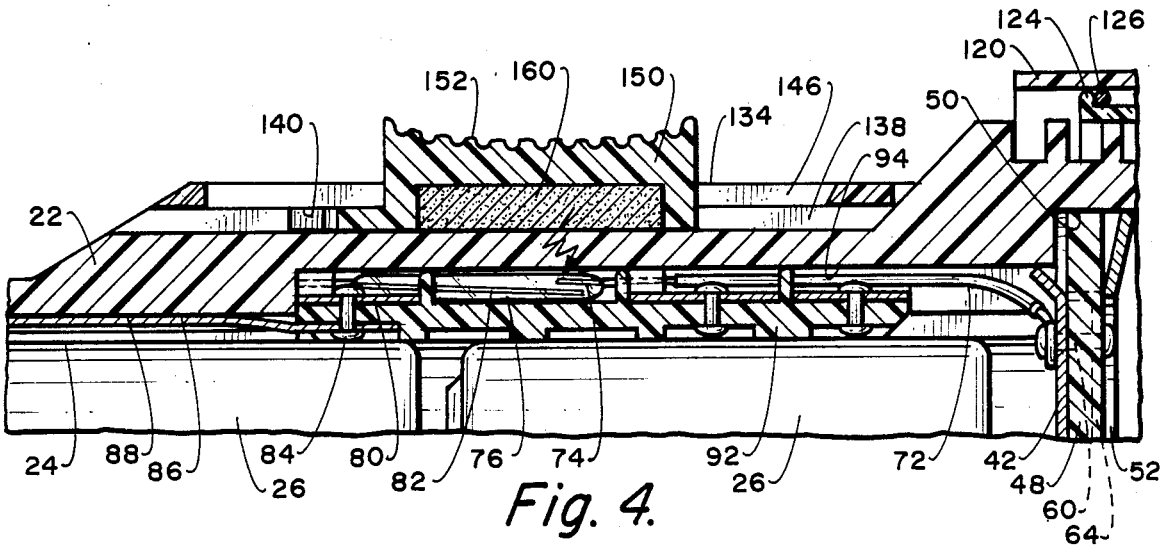
FIG. 4 is a view similar to FIG. 3, but showing the switch in a low beam activating position.
Figure 6:
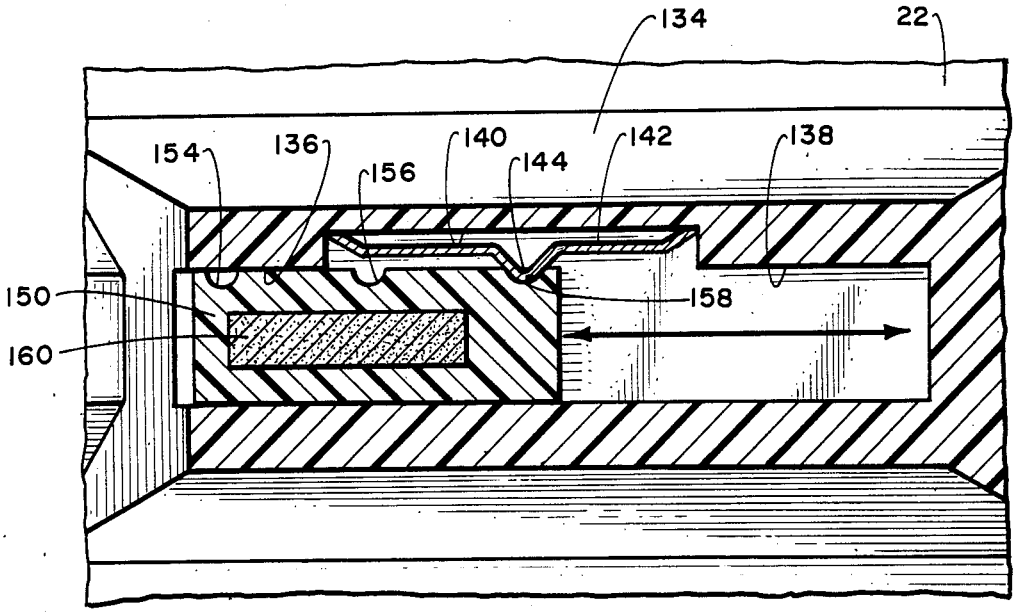
FIG. 6 is a cross-sectional view through a portion of the switch assembly incorporated within the waterproof flashlight of this invention taken along line 6—6 of FIG. 3.
Figure 7:
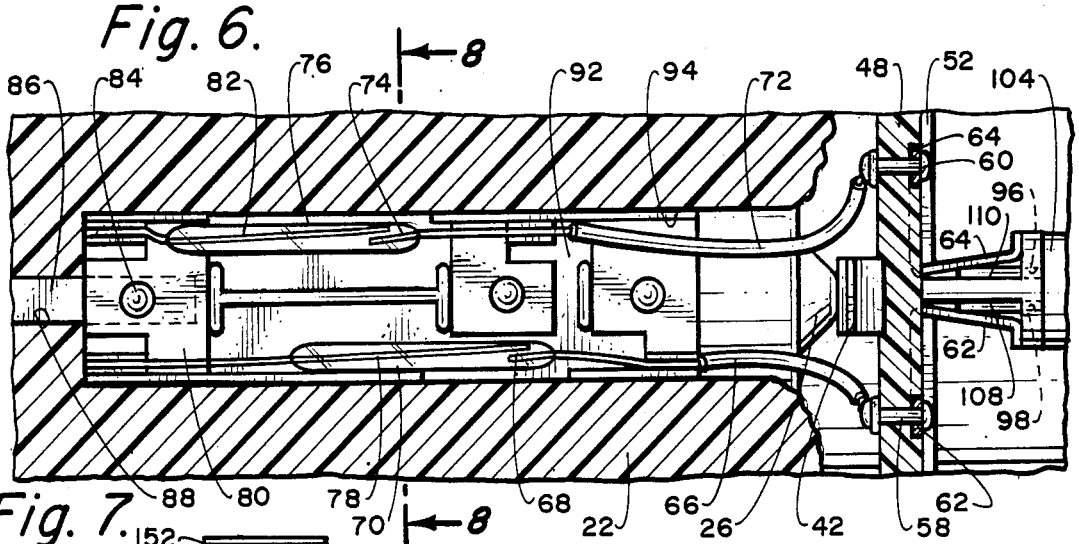
FIG. 7 is a view, partly in cross-section, through a portion of the switch assembly incorporated within the waterproof flashlight of this invention taken along line 7—7 of FIG. 3.
Figure 8:
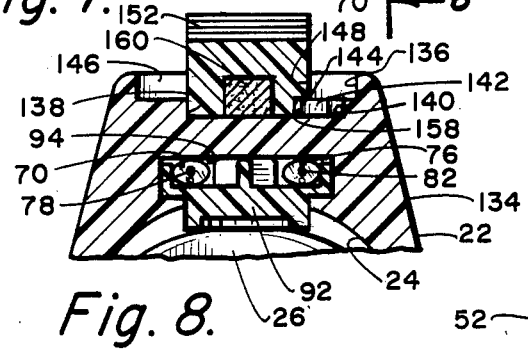
FIG. 8 is a cross-sectional view taken along line 8—8 of FIG. 7.
Figure 9:
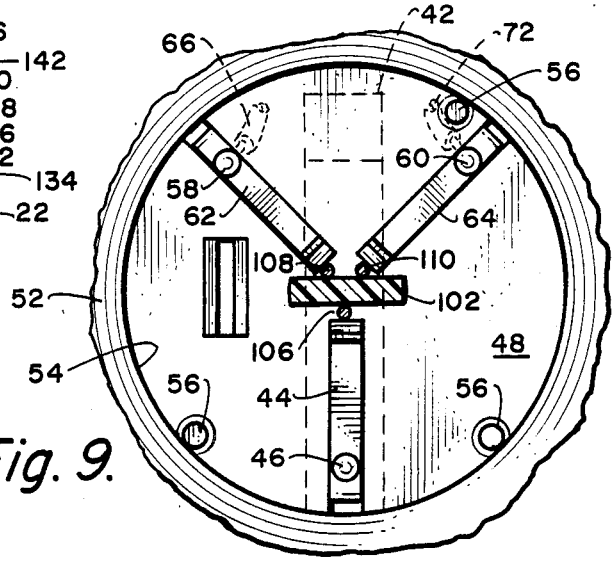
FIG. 9 is a cross-section view taken along line 9—9 of FIG. 2, showing in more detail the light bulb activation arrangement incorporated within the flashlight of this invention.

Mounted in a fixedly secured manner within the longitudinal recess 136 is a frame 146. The frame 146 includes elongated opening 148. Mounted in close proximity within the opening 148 is a button 150. The upper exterior surface 152 of the button 150 is recessed and includes a plurality of serrations in order to facilitate frictional contact with a persons thumb to achieve movement of the button 150 within the opening 148. The button 150 is slidable within the slot 138 and opening 148 and is capable of occupying three different positions. The button 150 in one of its side walls includes a plurality of spaced apart notches 154, 156 and 158. When the protuberance 144 connects with notch 158, the button 150 is positioned as shown in FIGS. 3 and 6. In this position, flashlight 20 is deactivated and no light is being emitted from the flashlight 104.

The interior surface of the button 150 includes a magnet 160. When the button 150 has been moved so that the protuberance 144 connects with the notch 156, the magnet 160 is positioned directly above the fixed contact 74 of the reed switch bubble 76. Because of the magnetic force, the movable contact 82 is pulled toward the magnet 160 until the free outer end of the movable contact 82 physically connects with the fixed contact 74. As this time a completed electrical circuit is obtained through the prong 110 of the light bulb 104. As a result of low level (intensity) of light is emitted from the light bulb 104.

Figure 5:
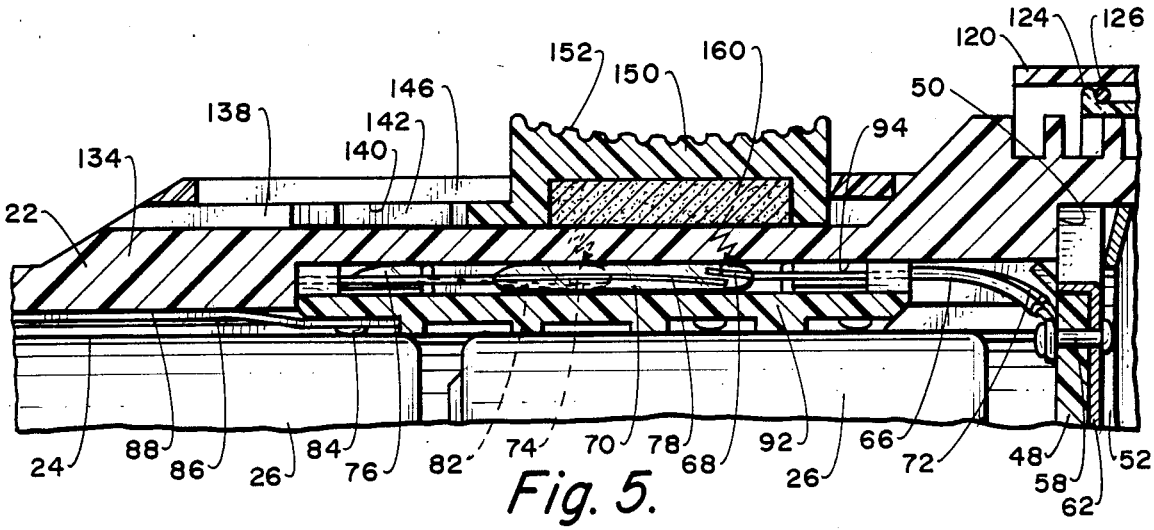
FIG. 5 is a view similar to FIG. 4, but showing the switch in a high beam activating position.

If it is desired to have a higher or brighter level of light to be emitted from the light bulb 104,the operator only needs to move the button 150 until the protuberance 144 connects with the notch 154 as shown in FIG. 5. In this position the magnet 160 not only maintains contacts 74 and 82 physically connected but will also cause movable contact 78 to be moved against fixed contact 68. As a result a second electrical closed circuit is achieved through prong 108 of the light bulb 104 which results in a second filament being lit within the light bulb 104.

Figure 12:
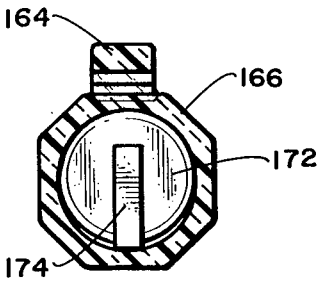
FIG. 12 is a transverse cross-sectional view taken along line 12—12 of FIG. 11.
Figure 10:
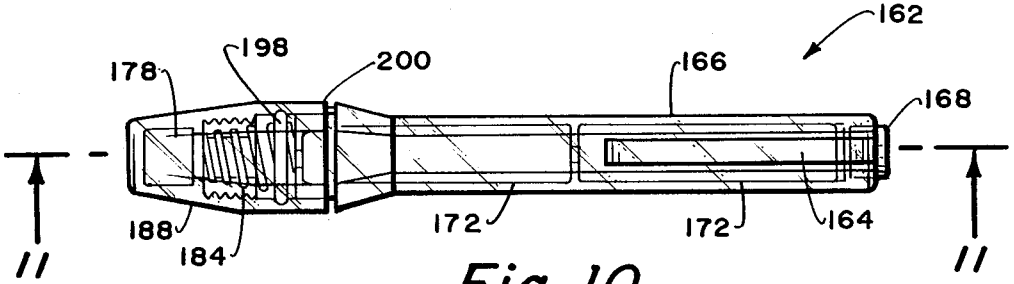
FIG. 10 is a side elevational view of the second embodiment of the flashlight of this invention.
Figure 11:
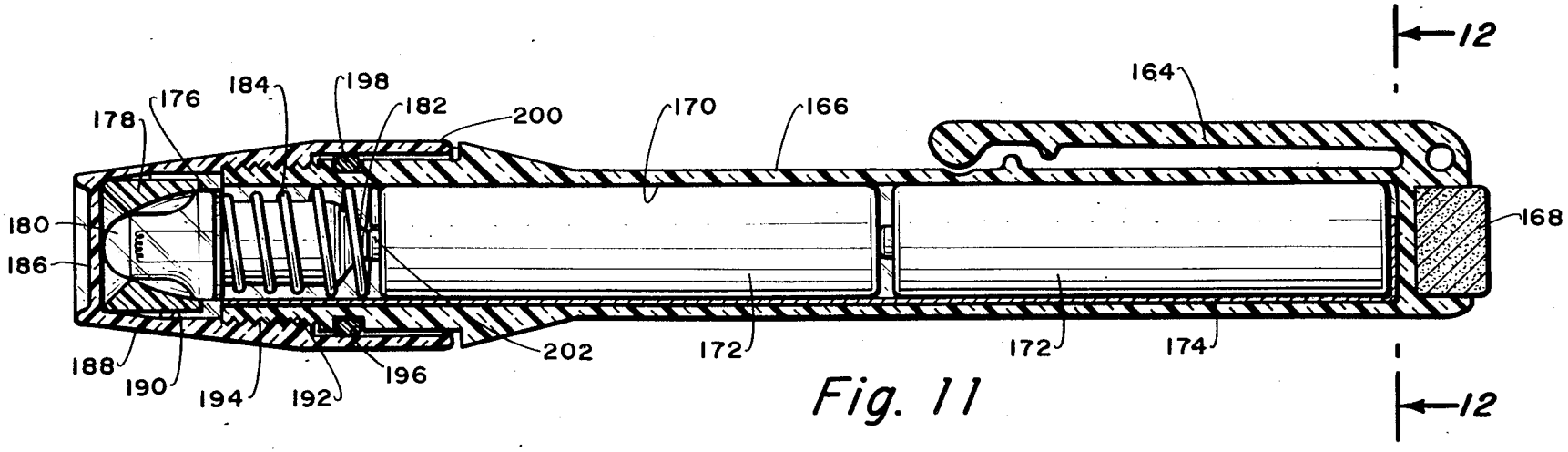
FIG. 11 is a cross-sectional view taken along line 11—11 of FIG. 10.

Referring particularly to FIGS. 10 through 12 of the drawings, there is shown the second embodiment 162 of the flashlight of this invention which is constructed to comprise a small pocket size flashlight. Flashlight 162 is to be connectable to one's shirt pocket by the use of a clip 164. The clip 164 is integrally mounted on tubular barrel 166. The aft end of the tubular barrel 166 is completely closed (not having a separate end cap) and has formed therein a magnet 168. The function of the magnet 168 is to facilitate mounting in conjunction with an exterior metal object (not shown).

Within the tubular barrel 166 is an internal chamber 170. Within the internal chamber 170 are located a pair of batteries 172 in an in-line manner. Incorporated within the internal chamber 170 is a ground conductor 174 which connects to the negative terminal of the rearwardmost battery 172. The ground conductor 174 then extends forwardly along the side wall of the internal chamber 170 and terminates directly adjacent metallic ring 176. Ring 176 abuts against bulb housing 178. Within the bulb housing 178 is mounted a light bulb 180. One terminal of the light bulb 180 connects to the ring 176 with the other terminal of the light bulb 180 connecting to contact 182. Contact 182 is to be connectable to the positive terminal of the forwardmost battery 172.

Located between the ring 176 and the battery 172 is a coil spring 184. The coil spring 184 exerts a continuous bias against the light bulb housing 180 tending to space such from the battery 172.

The forwardmost end of the light bulb housing 178 physically abuts against lens 186. Lens 186 is mounted within a lens housing 188. The lens housing 188 includes an internal chamber 190, part of which includes a series of screw threads 192. Screw threads 192 are to threadably engage with a series of external screw threads 194 formed on the tubular barrel 166. Mounted within an annular groove 196 formed within the tubular barrel 166 is an elastomeric O-ring seal 198. The O-ring seal 198 forms a watertight seal with the internal chamber 190 of the lens cover 188.

The lens housing 188 is to be threadingly moved relative to the barrel 166 in a direction toward annular protruding flange 200, formed on the barrel 166 until physical contact occurs with the positive contact 202 of the forwardmost battery 172. During this entire movement, the O-ring seal 198 maintains a watertight connection between the lens housing 188 and the barrel 166. When the contact 182 physically connects with the positive contact 202, the single filament of the light bulb 180 is activated emitting light through the lens 186.

It is to be understood that when it is desired to turn off the flashlight 162, the operator only needs to loosen the lens housing 188 a small amount which will cause the contact 182 to be spaced a small distance from the positive contact 202 due to the action of the coil spring 184.

What is claimed is:

1. A waterproof flashlight comprising:

a tubular barrel having an internal chamber, said internal chamber being adapted to receive a battery;

a light bulb mounted on said tubular barrel, said light bulb extending at least partially within said internal chamber, said light bulb being adapted to electrically connect with the battery, said light bulb having a high beam and a low beam;

a lens housing mounted on said tubular barrel enclosing said light bulb;

waterproof sealing means mounted between said lens housing and said tubular barrel for preventing entry of water into said internal chamber, said waterproof sealing means comprising at least one elastomeric O-ring seal;

a switch assembly mounted on said tubular barrel, said switch assembly being movable between an off position and a low beam position and a high beam position; and said switch assembly including a magnet mounted exteriorly of said tubular barrel and a magnetically operable switch assembly mounted within said internal chamber of said tubular barrel, said magnetically operable switch assembly being operable by said magnet with the electromagnetic force of said magnet being conducted through the wall of said tubular barrel.

2. The waterproof flashlight as defined in claim 1 wherein:

said tubular barrel including an end cap, a second elastomeric O-ring seal mounted between said end cap and said tubular barrel.

3. The waterproof flashlight as defined in claim 2 wherein:

said lens housing including an outer opaque cover within which is fixedly mounted an inner transparent cover through which passes the light from said light bulb, a reflector fixedly mounted within said inner transparent cover.

* * * * *